US005300946A

United States Patent [19]

Patrick

[11] Patent Number: 5,300,946

[45] Date of Patent: Apr. 5, 1994

[54] METHOD FOR OUTPUTTING TRANSPARENT TEXT

[75] Inventor: Stuart R. Patrick, Issaquah, Wash.

[73] Assignee: Microsoft Corporation, Redmond, Wash.

[21] Appl. No.: 986,793

[22] Filed: Dec. 8, 1992

[51] Int. Cl.[5] ..... G09G 1/28

[52] U.S. Cl. ..... 345/153; 345/141

[58] Field of Search ..... 340/703, 750, 800, 799; 395/129, 130, 131, 132; 345/141, 153

[56] References Cited

PUBLICATIONS

Barden, W. "Color Computer Assembly Language Programming" Tandy ©1983 pp. 31, 39–41.

Ferraro, R. "Programmer's Guide To The EGA and VGA Cards". Addison-Wesley. 1988 pp. 14, 17, 229–231.

IBM Personal System/2 and Personal Computer Bios Interface Technical Reference. 1987 (1st Ed) pp. 4–95, 4–96, and 4–99.

M. Abrash, "Write Mode 3 of the VGA"; 1988 *Programmer's Journal* 6.1: 16–23, 1988.

M. Abrash, "Faster Circles for the VGA"; 1990 *Programmer's Journal* 8.2: 18–31, 1990.

*Primary Examiner*—Alvin E. Oberley
*Assistant Examiner*—Aaron Banerjee
*Attorney, Agent, or Firm*—Seed and Berry

[57] ABSTRACT

The outputting of transparent text to a video display is improved by decreasing the time it takes to output the text. The time savings are realized by eliminating the "OUT" instruction that is particularly time consuming. This invention is especially well-adapted for use with a video graphics array (VGA) type video adapter.

7 Claims, 5 Drawing Sheets

| | | | |
|---|---|---|---|
| BYTE 0 | 0 0 0 0 0 0 0 0 | 0 0 0 0 0 0 0 0 | BYTE 7 |
| BYTE 1 | 0 0 0 0 0 0 0 1 | 1 0 0 0 0 0 0 0 | BYTE 8 |
| BYTE 2 | 0 0 0 0 0 0 1 0 | 0 1 0 0 0 0 0 0 | BYTE 9 |
| BYTE 3 | 0 0 0 0 0 1 1 1 | 1 1 1 0 0 0 0 0 | BYTE 10 |
| BYTE 4 | 0 0 0 0 1 0 0 0 | 0 0 0 1 0 0 0 0 | BYTE 11 |
| BYTE 5 | 0 0 0 1 0 0 0 0 | 0 0 0 0 1 0 0 0 | BYTE 12 |
| BYTE 6 | 0 0 0 0 0 0 0 0 | 0 0 0 0 0 0 0 0 | BYTE 13 |

METHOD FOR OUTPUTTING TRANSPARENT TEXT

DESCRIPTION

1. Technical Field

The present invention relates generally to data processing systems and, more particularly, to a method for outputting text to a video display through a video adapter.

2. Background of the Invention

Operating systems, such as the WINDOWS operating system, version 3.0, sold by Microsoft Corporation of Redmond, Wash., allow text to be output in different modes. Specifically, text may be output in either a transparent mode or an opaque mode. Unfortunately, the outputting of text in transparent mode is often quite slow.

SUMMARY OF THE INVENTION

It is an object of the present invention to provide an improved method for outputting transparent text to a video display through a video adapter.

It is a further object of the present invention to provide a method for outputting transparent text quickly to a video display through a video adapter.

The foregoing and other objects are realized by the present invention. In accordance with a first aspect of the present invention, a method of writing transparent text to a video display is realized in a data processing system. The data processing system includes a processor, a video display and a video adapter. The video adapter includes a bit mask register. In this method, a fixed bit pattern is written into the bit mask register, such as all "1" bits. A bit mask for the text is provided from the processor. The bit mask includes an associated bit for each pixel, indicating whether or not the pixel should be changed to a new color from a current color.

A logical operation is performed with the contents of the bit mask register and the bit mask to produce an effective bit mask. The current color of a pixel is changed to the new color if the associated bit in the effective bit mask indicates that the pixel is to be changed. In contrast, the current color of a pixel is not changed if the associated bit in the bit mask indicates that the pixel is not to be changed.

The step of performing a logical operation may comprise the step of logically bitwise ANDing the contents of the bit mask register with the bit mask. Furthermore, the step of changing the color of each pixel may further comprise the step of changing the color of each pixel, having an associated bit in the effective bit mask that is a "1", to the new color. The method may also include the additional step of storing the new color in a second register of the video adapter. Lastly, the current color and the new color may be encoded as four-plane values.

In accordance with another aspect of the present invention, a method of writing transparent text to a video display is practiced in the data processing system. The data processing system includes a processor, a video display and a video graphics array (VGA) type adapter. The adapter includes a bit mask register, a second register and a four-plane video memory.

In this method, a four-plane value for a new color is loaded into the second register of the adapter. A fixed bit pattern is written into the bit mask register of the adapter. A separate bit mask for the text is provided from the processor, and a logical operation is performed with the bit mask and the contents of the bit mask register to produce an effective bit mask. Each bit of the effective bit mask is associated with the pixel of the video display. For each bit in the effective bit mask that has a value of "1", the current four-plane value stored in the video memory is changed for the pixel, that is associated with the bit, to the four-plane value of the new color. On the other hand, for each bit in the effective bit mask that has a value of "0", the current color value stored in the video memory for the pixel associated with the bit is maintained so as to produce transparent text.

In accordance with yet another aspect of the present invention, a method is practiced in a data processing system having a processor, a video graphics array (VGA) type video adapter and a video display. The adapter includes a bit mask register and a video memory. In accordance with this method, a mode for the video adapter is set by the processor so that the processor data is logically bitwise ANDed with the bit mask register of the video adapter to produce an effective bit mask when a processor write to the video memory is performed. The bit mask register of the adapter is then stuffed with all 1's. A write to the video memory is subsequently performed, and the write causes the pixels designated in the effective bit mask to be changed to a new color.

DETAILED DESCRIPTION OF THE INVENTION

The slowness of the conventional approach to outputting transparent text in the WINDOWS operating system, version 3.0, is due to the execution of an OUT instruction. The OUT instruction takes a disproportionately large number of cycles to complete relative to other instructions that are executed in outputting the text in transparent mode.

A preferred embodiment of the present invention facilitates the outputting of transparent mode text in a quicker fashion. The time savings realized by the preferred embodiment described herein are attributable to the elimination of the OUT instruction in the code that outputs the transparent text. The preferred embodiment described herein may be implemented as part of a display driver for a video display device. The display driver is preferably part of an operating system, such as the WINDOWS operating system, version 3.1, sold by Microsoft Corporation of Redmond, Wash.

Figure 1:
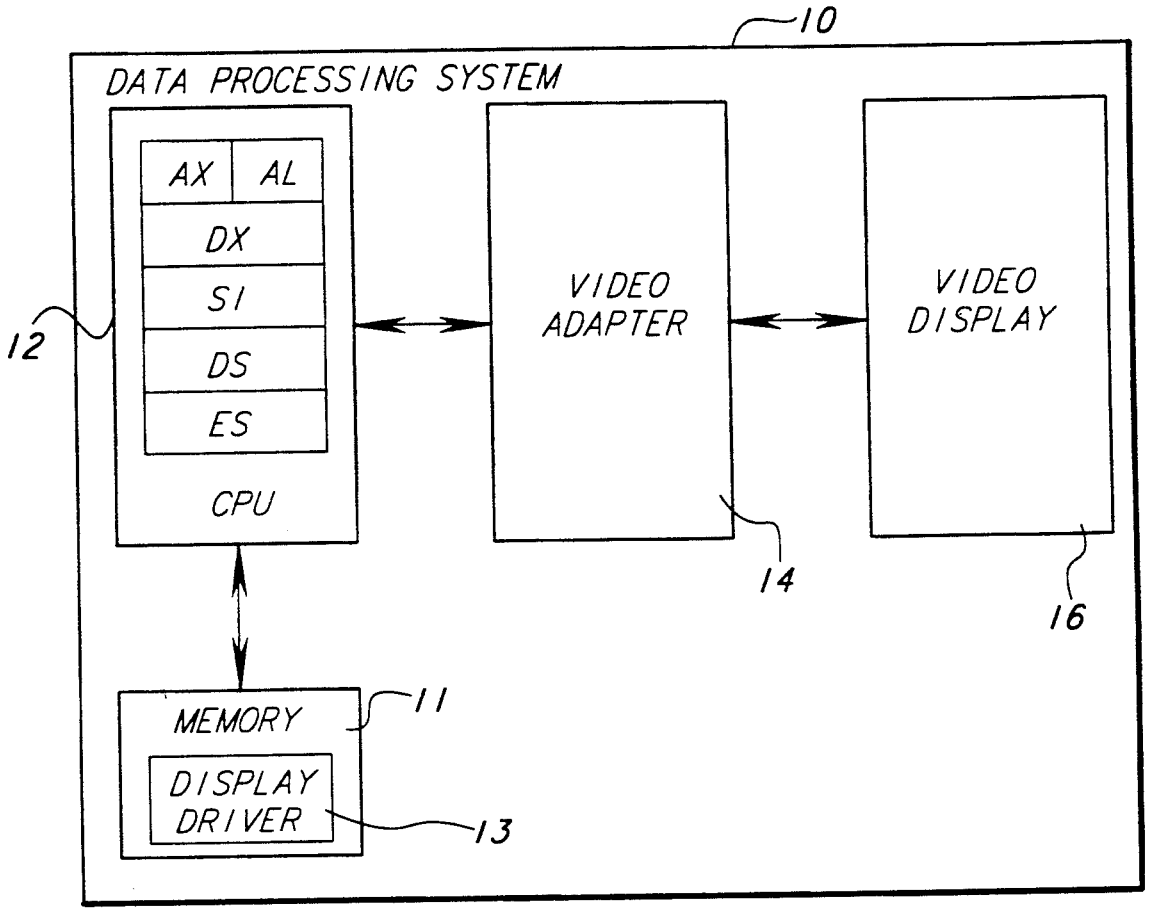
Figure 1 (PRIOR ART)
FIG. 1 is a block diagram of a prior art data processing system, having a video adapter.
Figure 2:
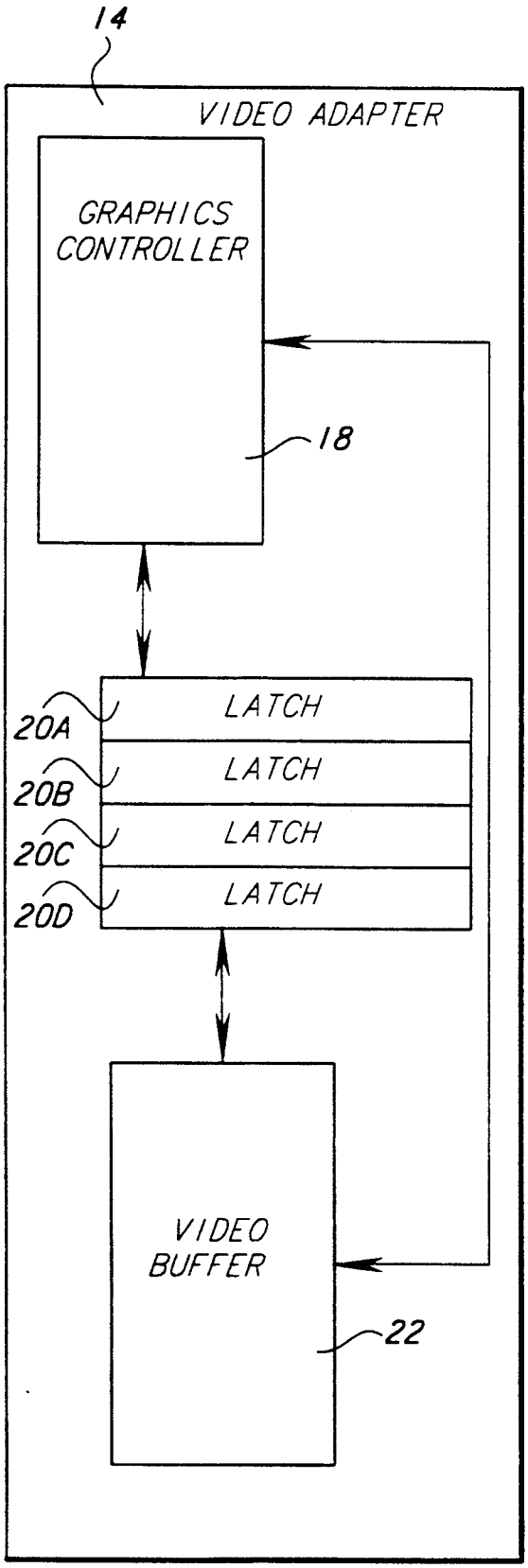
Figure 2 (PRIOR ART)
FIG. 2 is a more detailed block diagram of the video adapter of FIG. 1, including a graphics controller.

FIG. 1 is a block diagram of an illustrative conventional data processing system 10 for practicing the present invention. The data processing system includes a video adapter 14. The video adapter is a video graphics array (VGA) type adapter and acts as an interface between a central processing unit (CPU) 12 and a video display 16. The video adapter 14 converts digital video data from the CPU 12 into electric signals that are sent to the video display 16 to generate images. A more detailed view of the video adapter is shown in FIG. 2. The CPU may be an 80386 microprocessor, which includes a standard set of registers, such as the AX, AL, SI, DI, DS and ES registers. The data processing system also includes a memory 11 for holding data and code, including a display driver 13 for the video display 16.

The image generated by the video display 16 (FIG. 1) is produced by illuminating a number of discrete picture elements, known as pixels, in the video display 16. Each pixel is illuminated to produce a desired color. The color that a pixel produces is encoded in the digital data for the pixel. The digital data for the color includes red, green, blue and intensity components of the color. For example, a pure red pixel has only a red component, but has no green component and no blue component. Thus, the digital data encodes a red component, and encodes no green component and no blue component. On the other hand, other colors are encoded to include combinations of red, green and blue components. The intensity component specifies an intensity level for the color.

FIG. 2 is a block diagram showing several of the major components of the video adapter 14. The video adapter 14 includes a graphics controller 18 for controlling the video adapter. The video adapter also includes a video buffer 22 that holds digital image data for the image currently being displayed on the video display 16 (FIG. 1). The video buffer 22 is organized into four planes (one plane for each color component and one plane for intensity data). The color information for a pixel is encoded by the like positioned bit(s) in each of the four planes. A single address for the video buffer 22 references a byte from each of the four planes (i.e., 4 bytes in total). An 8-bit latch 20*a*, 20*b*, 20*c* and 20*d* is provided for each of the respective planes. The latches 20*a*, 20*b*, 20*c* and 20*d* are used to latch data into and out of the planes of the video buffer 22.

Figure 3:
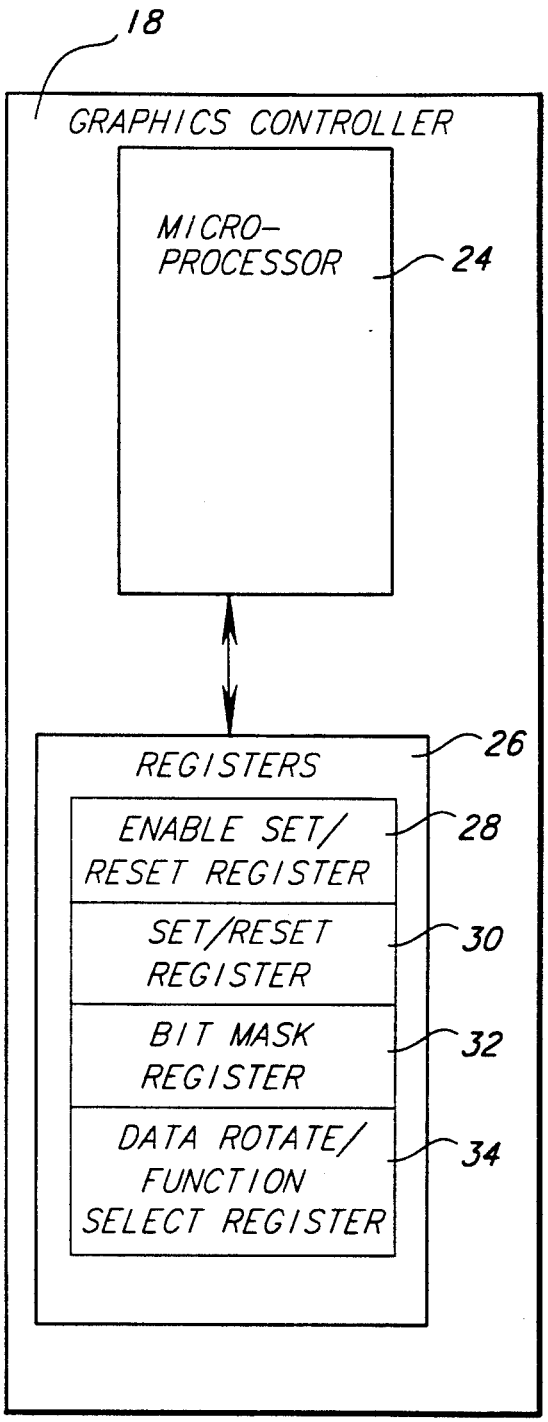
Figure 3 (PRIOR ART)
FIG. 3 is a more detailed block diagram of the graphics controller of FIG. 2.

The graphics controller 18 is shown in more detail in FIG. 3. The graphics controller 18 includes a microprocessor 24 and a set of registers 26. The microprocessor 24 oversees the activities of the graphics controller 18 and works in conjunction with the registers 26 in reading from and writing to the video buffer 22 (FIG. 2). The registers include an enable set/reset register 28, a set/reset register 30, a bit mask register 32 and a data rotate/function select register 34. The roles served by these registers 26 will be described in more detail below.

Figure 4A:
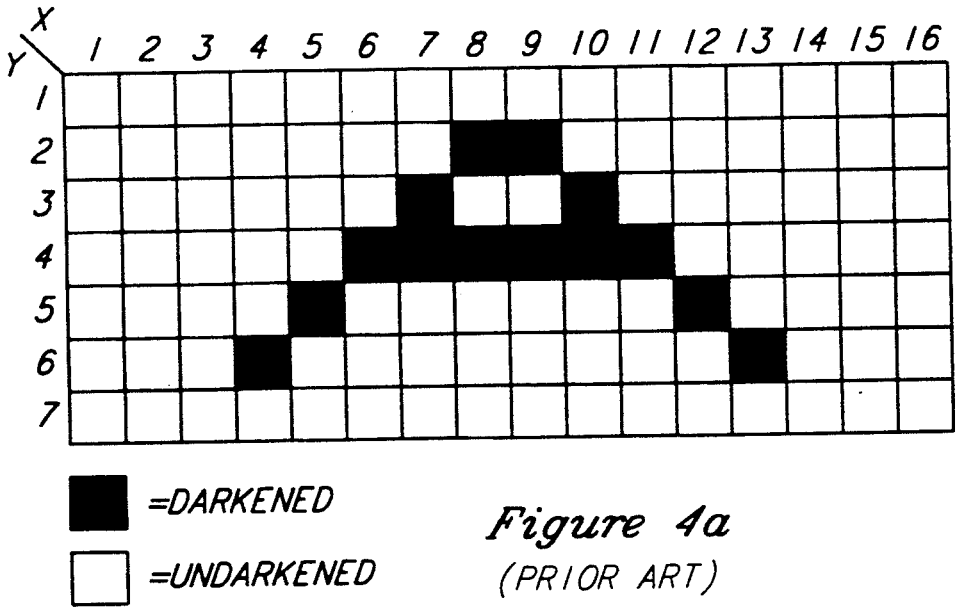
Figure 4a (PRIOR ART)
FIG. 4*a* is a depiction of a block of pixels that are illuminated for the character "A" using the system of FIG. 1.

In generating text output on the visual display 16 (FIG. 1), the operating system executed by CPU 12 (FIG. 1) uses a font. The font is a set of characters in which each character has a common size, style and weight. The font may include bitmaps for each character in the font. The bitmap of a character illustrates how pixels in a block of pixels are to be illuminated to generate the character. For instance, suppose that a font table in the memory 11 (FIG. 1) holds an entry for the character 'A'. FIG. 4*a* illustrates the illumination of the pixels in a block for generating the character 'A'. The darkened pixels create the character against a background of non-darkened pixels.

Figures 4B, 5:
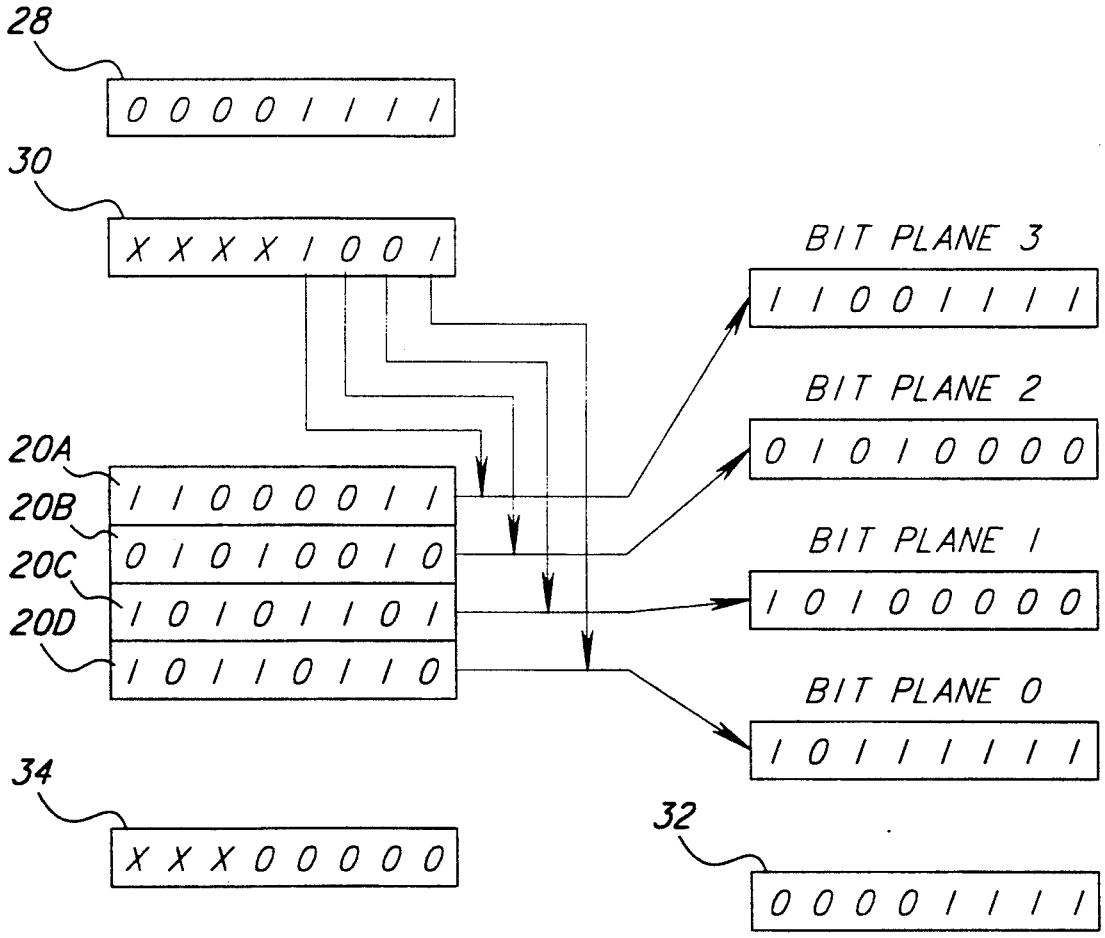
Figure 4b (PRIOR ART)
Figure 5 (PRIOR ART)
FIG. 4*b* illustrates the bytes used in a bitmap of a font for the pixel pattern of FIG. 4*a*.
FIG. 5 illustrates the register values, latches values and bit plane values for an example of writing transparent text to the video display of FIG. 1.

The bitmap of FIG. 4*a* is stored in memory 11 (FIG. 1) in a file as a series of bytes, as shown in FIG. 4*b*. A bit is provided in the bitmap for each pixel. A "0" value for a bit indicates that the associated pixel is assigned a first color, and a "1" value for a bit indicates that the associated pixel is assigned a second color. The pixels are broken down into groups of 8 contiguous pixels of a row and are encoded as a byte of the bitmap. The bytes are stored in the sequence shown in FIG. 4*b*. The bitmap includes 14 bytes in total (for 112 pixels) in the example of FIG. 4*b*.

The manner in which the bitmap of the font is used when text is output depends on the type of video display 16 being used. In a monochrome display, each pixel of the bitmap is assigned a color of black or white. Specifically, pixels with a "0" value are assigned the color of white, and pixels with a "1" value are assigned the color of black. In a full-color display, however, the two colors specified by the "1" and the "0" values in the bitmap are not restricted to black and white. Rather, the "1" value and the "0" value may encode other non-monochrome colors. For instance, the "1" value may encode the color red, whereas the "0" value may encode the color blue.

As mentioned above, the WINDOWS operating system, version 3.0, allows text to be displayed in either a transparent mode or an opaque mode. In transparent mode, the pixels having a value of "1" in the corresponding bit of the bitmap are changed to a foreground color. The pixels with a value of "0" in the corresponding bit of the bitmap are not changed. Instead, the colors currently assigned to these pixels are kept the same so as to produce a transparent effect. In contrast, in opaque mode, each pixel with a value of "0" in the corresponding bit of the bitmap is assigned a distinct background color that paints over the currently assigned color for the pixel.

When the WINDOWS operating system, version 3.0, is running and the background mode has been selected as opaque mode, an application program may set the color for the foreground pixels by calling the SetTextColor function. Similarly, the application program may set the color for the background pixels by calling the SetBkColor function. Both the SetTextColor and SetBkColor functions are provided as part of the WINDOWS operating system, version 3.0. A call to either of these functions results in a call to the display driver 13 (FIG. 1), which is passed red, green and blue values for the requested color of the text or background. The display driver 13 converts the red, green and blue values into the closest matching four-plane values (i.e., red, green, blue and intensity values) that are provided by the video adapter 14 (FIG. 1). The four-plane values are then remembered by the WINDOWS operating system, version 3.0, for future use. When the application program subsequently seeks to output text, the application program makes a call to an output function, such as TextOut. The four-plane values for the colors and the string to be output are passed to the display driver 13 for the video display 16. The display driver 13 uses this information, along with font information to interact with the video adapter 14 and generate textual output.

The VGA-type video adapter 14 may operate in one of several modes. FIG. 5 shows an example of operation of the VGA-type video adapter 14 (FIG. 1) in write mode 0. In write mode 0, the CPU 12 seeks to write new data into the video buffer 22 (FIG. 2) to change the video display 16 (FIG. 1). The image data that is written to the video buffer 22 is in large part controlled by the registers 26 (FIG. 3) of the graphics controller 18. The value in the enable set/reset register 28 (FIG. 5) determines whether the bit planes of the video buffer 22 are changed on a byte-by-byte basis or on a pixel-by-pixel basis. When the enable set/reset register 28 has a hexadecimal value of "0F", as in FIG. 5, the bit planes are updated on a pixel-by-pixel basis. In this instance, the pixel values in the latches 20*a*, 20*b*, 20*c* and 20*d* are combined with the values in the set/reset register 30 using a logical operation, that is specified by the data rotate/function select register 34. On the other hand, if the enable set/reset register 28 has a value of "00" (hexadecimal), the CPU data 54 is updated on a byte-by-byte basis.

Bits 3 and 4 of the data rotate/function select register 34 specify the type of logical operation to be performed (e.g., replace, AND, OR or XOR). A "00" value specifies a replace operation; a "01" value specifies a bitwise logical AND operation; a "10" value specifies a bitwise logical OR operation; and a "11" value specifies a bitwise logical exclusive OR operation. In the present example, these bits have a "00" value and, thus, a replacement operation is performed.

The bit mask register 32 specifies how the new values for the associated pixels shown in FIG. 5 are to be derived. A value of "1" in a bit position in the bit mask register 32 indicates that the corresponding pixel is to be updated by combining the latched data with set/reset register data, using the logical operation that is specified by bits 3 and 4 of the data rotate/function select register 34. A value of "0" in a bit position of the bit mask register 32 indicates that the pixel value is to be copied directly from the latches 20*a*, 20*b*, 20*c* and 20*d* into the bit planes 0, 1, 2 and 3. In the present example, four of the bits in the bit mask register 32 have a value of "1". The updated values for the pixels associated with these bits are created by replacing the latched data with the color data in the set/reset register 30. The remaining pixels are not changed. The resulting bytes in the bit planes 0 through 3 are shown in FIG. 5.

Figure 6:
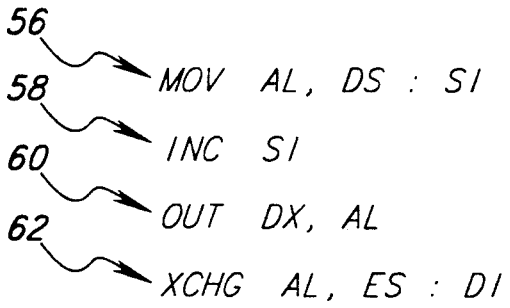
Figure 6 (PRIOR ART)
FIG. 6 is an X86 assembly language code section for outputting transparent text in the prior art.

The display driver 13 (FIG. 1) in the WINDOWS operating system, version 3.0, is responsible for interfacing with the video adapter 14 (FIG. 1) to write on the video display 16. This display driver 13 includes a code section (written in 80386 assembly language) for writing transparent text to the video display 16. The code is shown in FIG. 6. At line 56 of the code, the contents of the bitmap (from the font) are moved from a source address to a destination address by the MOV instruction. The source address is specified as a segment and an offset, wherein the segment is identified by a value in the DS register and the offset is identified by the value in the SI register. The destination address is the AL (accumulator register). In line 58, the value of the SI register is incremented by one by the INC instruction to point to the next entry in the same segment. This incrementing is helpful in reading blocks of consecutive memory locations. In line 60, the bitmap, that has been loaded into the AL register, is output by the OUT instruction to a port that is specified by a value in the DX register. As a result, the bitmap is output to the port leading to the video adapter, and the bitmap is written into the bit mask register 32 (FIG. 5) of the graphics controller 18 (FIG. 2). In line 62, the contents of the accumulator register AL (i.e., the bitmap) are then exchanged (via the XCHG instruction) with the contents of a memory location in the video buffer 22 (FIG. 2) at a segment specified by the ES segment register and an offset specified by the DI register.

In order to understand how the code section of FIG. 6 causes data to be output onto the video display 16 (FIG. 1), it is helpful to consider the values that are located in the registers of FIG. 5 when this code section is executed. The enable set/reset register 28 is loaded with a hexadecimal value of "0F" to indicate that data is to be written on a pixel-by-pixel basis. The set/reset register 30 is loaded with a four-plane value for the color of the foreground pixels in the text that is to be output. In the example of FIG. 5, the four-plane color value for the foreground pixels is "1001". The data rotate/function select register 34 has zeros in bit positions 3 and 4 to indicate that the logical operation to be performed is a replacement operation. The instruction at line 56 causes the bitmap for the text to be written into the AL register.

The execution of the OUT instruction at line 60 (FIG. 6) causes the bitmap held in the AL register to be written into the bit mask register 32 (FIG. 5). Accordingly, the bit mask register 32 is written to have a value of "00001111". The execution of the XCHG instruction at line 62 (FIG. 6) causes several operations to occur. First, the CPU 12 (FIG. 1) reads the current colors for the pixels in the video memory at ES:DI into the latches 20*a*, 20*b*, 20*c* and 20*d* (FIG. 5). The CPU 12 (FIG. 1) then writes the information in the latches 20*a*, 20*b*, 20*c* and 20*d* as modified. Specifically, where a "1" bit value is found in the bit mask register 32, the foreground color stored in the set/reset register 30 replaces the four-plane value for the color of the pixel in the bit planes. In contrast, where a "0" bit value is found in the bit mask register 32 for a pixel, the pixel information stored in the bit planes is not changed; rather, the current four-plane value for the color of the pixel is kept. As a result, only the foreground pixels are changed and a transparent effect is produced.

The preferred embodiment of the present invention described herein eliminates the need for the OUT instruction by operating the video adapter 14 (FIG. 1) in write mode 3 (rather than write mode 0) and stuffing the bit mask register 32 (FIG. 5) with all 1's. Write mode 3 for the VGA-type video adapter 14 is much like write mode 0, but differs in that the effective bit mask is created by ANDing a CPU data byte with the bit mask register. By stuffing the bit mask register with all "1" bits, the preferred embodiment described herein causes the CPU data byte to act as the effective bit mask. Accordingly, the bit mask is passed to the video adapter 14 (FIG. 1) without the need for executing the OUT instruction. The instructions of FIG. 6, other than line 60, are executed in the preferred embodiment described herein to write transparent text to the video display 16 (FIG. 1).

Figure 7:
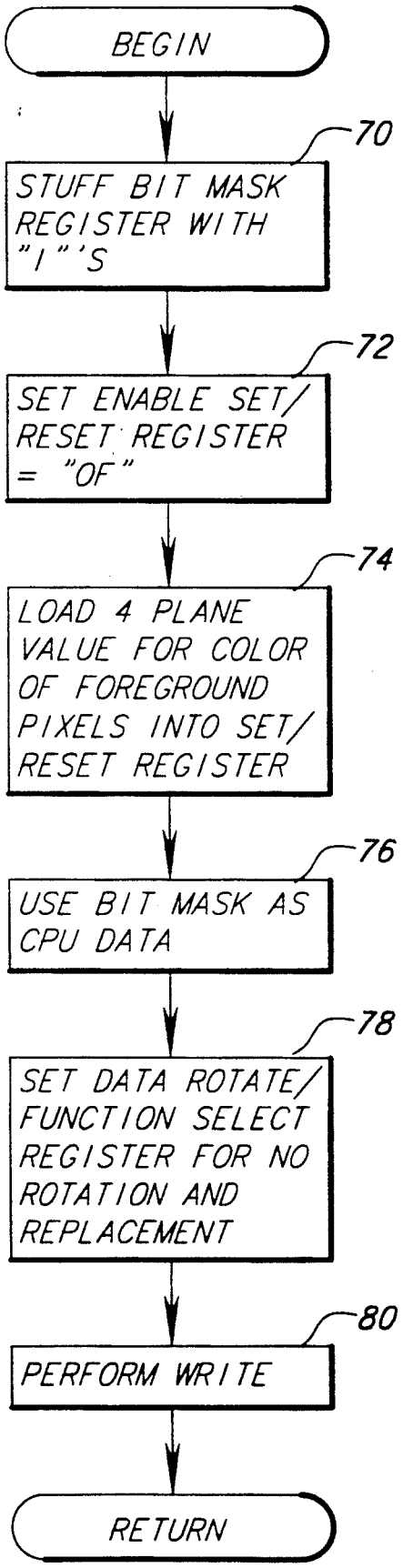
FIG. 7 is a flowchart of the steps performed by a preferred embodiment of the present invention.

FIG. 7 shows a flowchart of the steps performed by the preferred embodiment of the present invention described herein in writing transparent text to the video display 16 (FIG. 1). The steps shown in FIG. 7 will be described in conjunction with FIG. 8, which shows the relevant registers, latches and bit plane bytes of the video adapter 14. Initially, the preferred embodiment described herein stuffs the bit mask register 32 with all "1" bits (step 70 in FIG. 7). The bit mask register 32 (FIG. 8) only needs to be stuffed with "1" bits a single time for each time that a string of characters is to be displayed. Stuffing the bit mask register 32 with all "1" bits, unfortunately, requires the execution of OUT instructions. The OUT instructions, however, need not be executed every time that a new byte of pixels are set for a string. As such, substantial time savings are still realized.

When a string is ready to be output, the enable set/reset register 28 is filled with a hexadecimal value of "0F" (step 72 in FIG. 7). As was discussed above, storing this value in the enable set/reset register 28 causes the data in the bit planes to be updated on a pixel-by-pixel basis. The CPU 12 (FIG. 1) then loads a four-plane value for the color of the foreground pixels into the set/reset register 30 (FIG. 8) (step 74 in FIG. 7). This four-plane value is used to replace the current four-plane value for each pixel having a "1" in its corresponding bit of the effective bit mask.

Figure 8:
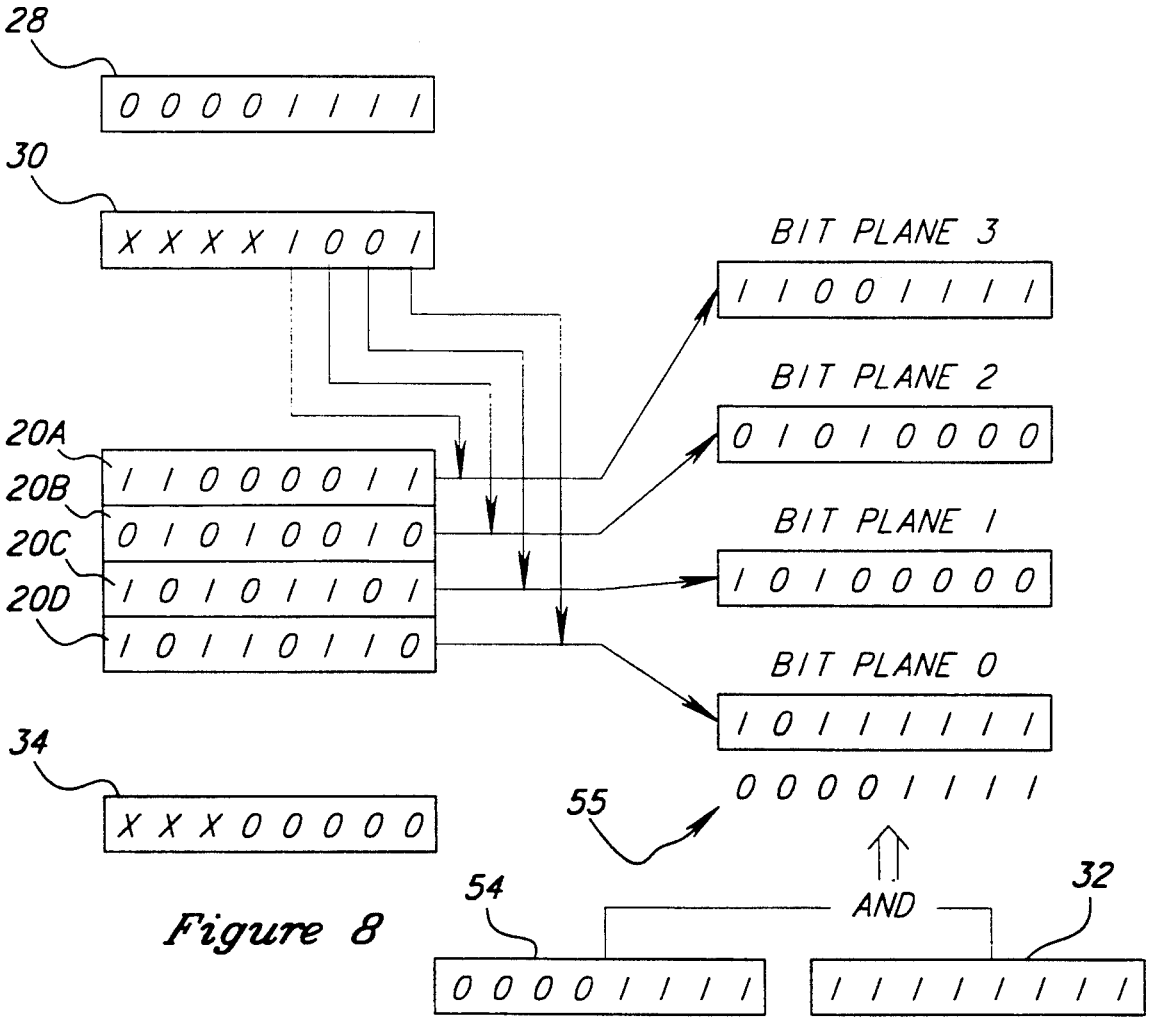
FIG. 8 illustrates the register values, latches values and bit plane values for an example of the preferred embodiment of the present invention.

Since the accumulator register AL (FIG. 1) holds the bitmap, the execution of the XCHG instruction at line 62 (FIG. 6) in the preferred embodiment described herein causes the CPU data to be used as the effective bit mask (see step 76 in FIG. 7). The CPU data 54 is logically bitwise ANDed with the contents of the bit mask register 32 to produce an effective bit mask 55. As can be seen in FIG. 8, when the CPU data 54 has a value of "00001111" and the bit mask register has a value of "11111111", the effective bit mask 55 is changed to have the same value as the CPU data 54.

The data rotate/function select register 34 is then set for no rotation and for a replacement logical operation (step 78 in FIG. 7). As was discussed above, bits 3 and 4 of the data rotate/function select register 34 specified the logical operation to be performed in combining the contents of the set/reset register 30 with the data in the latches 20*a*, 20*b*, 20*c* and 20*d*. A value of "00" for these bits indicates a replacement operation. Bits 0–2 of the data rotate/function select register 34 specify how many bit positions the CPU data 54 is to be rotated to the right. In the example of FIG. 8, these bits hold a value of "000" and, hence, the CPU data 54 is not rotated.

Given the register values, the write is then performed (step 80 in FIG. 7). The example shown in FIG. 8 indicates how the preferred embodiment described herein performs the same write that was illustrated for a conventional system in FIG. 5. Since four of the pixels in the effective bit mask 55 have a value of "1", the corresponding pixels are replaced with the color set forth in the set/reset register 30. Those pixels having corresponding bit values of "0" are not modified. The result of this replacement is outputting of transparent text. By adopting this approach, the preferred embodiment described herein is able to still output transparent text, but without the added overhead incurred by the OUT instruction.

While the present invention has been described with reference to a preferred embodiment thereof, those skilled in the art will appreciate that various changes in form and scope may be made without departing from the spirit of the present invention as defined in the appended claims.

I claim:

1. In a data processing system having a processor, a video display and a video adapter, wherein said video adapter includes a bit mask register, a method of writing transparent text to the video display comprising the steps of:

a) writing a fixed bit pattern into the bit mask register;

b) providing a bit mask from the processor for the text that indicates which pixels of the video display are to be changed to a new color from a current color and which pixels are not to be changed, wherein the bit mask includes an associated bit for each pixel indicating whether or not the pixel is to be changed to the new color;

c) performing a logical operation with contents of the bit mask register and the bit mask to produce an effective bit mask;

d) changing the color of each pixel, having an associated bit in the effective bit mask that indicates that the pixel is to be changed to the new color; and e) keeping the current colors of each pixel having an associated bit in the effective bit mask that indicates that the pixel is not to be changed to create transparent text.

2. A method as recited in claim 1, wherein the step of writing a fixed bit pattern into the bit mask register further comprises the step of writing all "1" bits into the bit mask register.

3. A method as recited in claim 1, wherein the step of performing a logical operation further comprises the step of logically bitwise ANDing the contents of the bit mask register with the bit mask.

4. A method as recited in claim 1, wherein the step of changing the color of each pixel further comprises the step of changing the color of each pixel having an associated bit in the effective bit mask with a value of "1" to the new color.

5. A method as recited in claim 1, further comprising the step of storing the new color in a second register of the video adapter.

6. A method as recited in claim 1, wherein the current color and the new color are encoded as four-plane values.

7. In a data processing system having a processor, a video display and a video graphics array (VGA) type adapter, wherein said adapter includes a bit mask register, a second register and a four-plane video memory, a method of writing transparent text to the video display comprising the steps of:

a) loading a four-plane value for a new color into the second register of the adapter;

b) writing a fixed bit pattern into the bit mask register of the adapter;

c) providing a bit mask from the processor for the text;

d) performing a logical operation with the bit mask and the bit mask register to produce an effective bit mask, each bit of the effective bit mask being associated with a pixel of the video display;

e) for each bit in the effective bit mask that has a value of "1", changing a current four-plane color value stored in the video memory for the pixel associated with the bit to the four-plane value of the new color, which is stored in the second register; and f) for each bit in the effective bit mask that has a value of "0", not changing a current color value stored in the video memory for the pixel associated with the bit, so as to produce transparent text.

* * * * *